US011247453B2

(12) United States Patent
Yoshida et al.

(10) Patent No.: US 11,247,453 B2
(45) Date of Patent: Feb. 15, 2022

(54) LIQUID EJECTING HEAD AND LIQUID-EJECTING RECORDING APPARATUS

(71) Applicant: SII PRINTEK INC., Chiba (JP)

(72) Inventors: Kensuke Yoshida, Chiba (JP); Toshiaki Watanabe, Chiba (JP)

(73) Assignee: SII PRINTEK INC., Chiba (JP)

( * ) Notice: Subject to any disclaimer, the term of this patent is extended or adjusted under 35 U.S.C. 154(b) by 3 days.

(21) Appl. No.: 16/801,462

(22) Filed: Feb. 26, 2020

(65) Prior Publication Data

US 2020/0298557 A1 Sep. 24, 2020

(30) Foreign Application Priority Data

Mar. 19, 2019 (JP) ..... JP2019-051549

(51) Int. Cl.
*B41J 2/045* (2006.01)
*B41J 2/14* (2006.01)

(52) U.S. Cl.
CPC ..... *B41J 2/04508* (2013.01); *B41J 2/04541* (2013.01)

(58) Field of Classification Search
CPC ..... B41J 2/04555
See application file for complete search history.

(56) References Cited

U.S. PATENT DOCUMENTS 5,757,392 A 5/1998 Zhang
6,076,914 A 6/2000 Imai
9,555,626 B1 * 1/2017 Aiba ..... B41J 2/04508
2006/0061615 A1 * 3/2006 Yagi ..... B41J 2/0451 347/19
2012/0249638 A1 10/2012 Takano et al.
2012/0293576 A1 11/2012 Kim et al.
(Continued)

FOREIGN PATENT DOCUMENTS

EP 1260370 A2 11/2002
EP 1600294 A1 11/2005
(Continued)

OTHER PUBLICATIONS

English translation of KR100684512 B1 to Kim et al., "Apparatus for Testing the Fullness of Ink and Test Method Therof"; translation retrieved via FIT database on Aug. 19, 2021; 23pp.*
(Continued)

*Primary Examiner* — Shelby L Fidler
(74) *Attorney, Agent, or Firm* — Crowell & Moring LLP

(57) ABSTRACT

There are provided a liquid ejecting head and a liquid-ejecting recording apparatus in which it is possible to improve convenience. According to an embodiment of the present disclosure, a liquid ejecting head includes an ejecting section including a plurality of nozzles for ejecting liquid, a driving circuit that drives the ejecting section based on a printing driving signal to eject the liquid from the nozzles, a power supply path connected to the driving circuit, a detection section that acquires measurement data based on a detection result of a current flowing on the power supply path, and an arithmetic operation section that performs both an inspection of a state of the ejecting section based on the measurement data obtained by the detection section and acquisition of a parameter for ejection of the liquid.

7 Claims, 10 Drawing Sheets

(56) References Cited

U.S. PATENT DOCUMENTS

| | | | | |
|---|---|---|---|---|
| 2014/0002538 | A1* | 1/2014 | Benjamin | B41J 2/0451 347/19 |
| 2015/0062219 | A1 | 3/2015 | Otokita | |
| 2015/0258780 | A1 | 9/2015 | Hayashi | |
| 2019/0202199 | A1* | 7/2019 | Bird | B41J 2/0451 |

FOREIGN PATENT DOCUMENTS

| | | | |
|---|---|---|---|
| EP | 1865311 | A1 | 12/2007 |
| JP | H09-286121 | A | 11/1997 |
| JP | 2012-240416 | A | 12/2012 |
| JP | 2017-105219 | A | 6/2017 |
| KR | 100684512 | B1 * | 2/2007 |

OTHER PUBLICATIONS

Extended European Search Report in Europe Application No. 20160219.0, dated Jul. 28, 2020, 11 pages.

* cited by examiner

MODIFICATION EXAMPLE 3

LIQUID EJECTING HEAD AND LIQUID-EJECTING RECORDING APPARATUS

RELATED APPLICATIONS

This application claims priority to Japanese Patent Application No. 2019-051549, filed on Mar. 19, 2019, the entire content of which is incorporated herein by reference.

BACKGROUND OF THE INVENTION

1. Field of the Invention

The present disclosure relates to a liquid ejecting head and a liquid-ejecting recording apparatus.

2. Description of the Related Art

A liquid-ejecting recording apparatus including a liquid ejecting head is used in various fields, and various types of liquid ejecting heads have been developed (for example, JP2012-240416A).

SUMMARY OF THE INVENTION

In such a liquid ejecting head and a liquid-ejecting recording apparatus, improvement of convenience is required.

It is desired to provide a liquid ejecting head and a liquid-ejecting recording apparatus, in which it is possible to improve convenience.

According to an embodiment of the present disclosure, a liquid ejecting head includes an ejecting section including a plurality of nozzles for ejecting liquid, a driving circuit that drives the ejecting section based on a printing driving signal to eject the liquid from the nozzles, a power supply path connected to the driving circuit, a detection section that acquires measurement data based on a detection result of a current flowing on the power supply path, and an arithmetic operation section that performs both an inspection of a state of the ejecting section based on the measurement data obtained by the detection section and acquisition of a parameter for ejection of the liquid.

According to still another embodiment of the present disclosure, a liquid-ejecting recording apparatus includes the liquid ejecting head according to the embodiment of the present disclosure.

According to the liquid ejecting head and the liquid-ejecting recording apparatus according to the embodiment of the present disclosure, it is possible to improve the convenience.

DETAILED DESCRIPTION OF THE PREFERRED EMBODIMENTS

Hereinafter, an embodiment of the present disclosure will be described in detail with reference to the drawings. The description will be made in order as follows.

1. Embodiment (example of arithmetic operation processing in which both inspection of filling state with ink and acquisition of AP value are performed)
2. Modification Examples
   Modification Examples 1 and 2 (another example of arithmetic operation processing)
   Modification Example 3 (example in a case where acquisition of drive voltage in printing driving signal and the like is performed)
3. Other modification examples

1. EMBODIMENT

A. Overall Configuration of Printer 1

Figure 1:
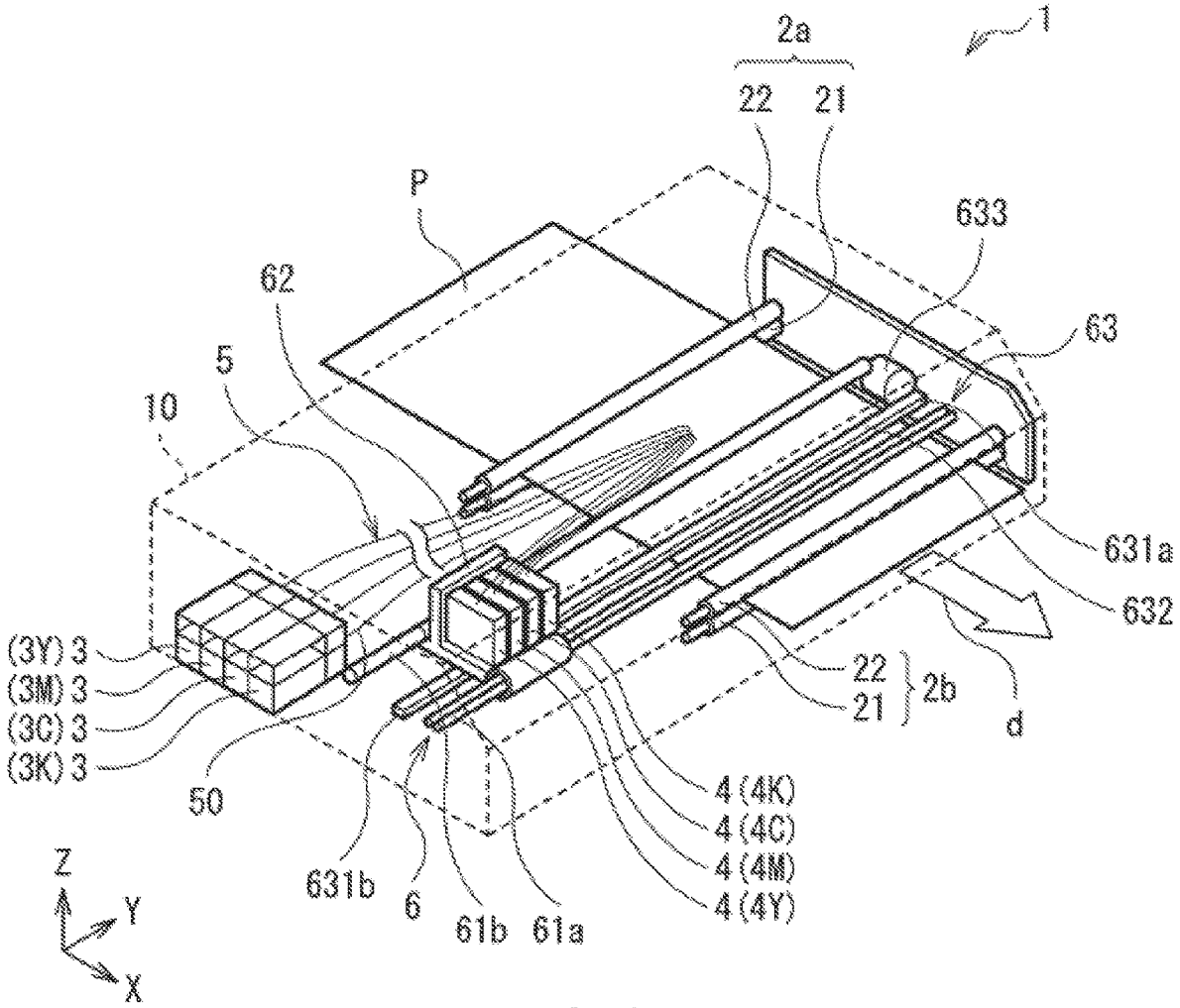
FIG. 1 is a schematic perspective view illustrating a schematic configuration example of a liquid-ejecting recording apparatus according to an embodiment of the present disclosure.

FIG. 1 is a perspective view schematically illustrating a schematic configuration example of a printer 1 as a liquid-ejecting recording apparatus according to an embodiment of the present disclosure. The printer 1 is an ink jet printer that performs recording (printing) of an image, characters, or the like on recording paper P as a recording medium with an ink 9 described later.

As illustrated in FIG. 1, the printer 1 includes a pair of transport mechanisms 2*a* and 2*b*, an ink tank 3, an ink jet head 4, an ink supply tube 50, and a scanning mechanism 6. The members are accommodated in a housing 10 having a predetermined shape. In the drawings used in the description of this specification, the scale of each member is appropriately changed in order to set the size of each member to be recognizable.

Here, the printer 1 corresponds to a specific example of "a liquid-ejecting recording apparatus" in present disclosure. The ink jet head 4 (ink jet heads 4Y, 4M, 4C, and 4K described later) corresponds to a specific example of "a liquid ejecting head" in the present disclosure. The ink 9 corresponds to a specific example of "a liquid" in the present disclosure.

As illustrated in FIG. 1, each of the transport mechanisms 2*a* and 2*b* is a mechanism that transports recording paper P in a transport direction d (X-axis direction). Each of the transport mechanisms 2*a* and 2*b* includes a grid roller 21, a pinch roller 22, and a driving mechanism (not illustrated). The driving mechanism rotates the grid roller 21 around the axis (rotates in a Z-X plane) and is configured by a motor and the like, for example.

Ink Tank 3

The ink tank 3 is a tank that accommodates the ink 9 therein. As the ink tank 3, in this example, as illustrated in FIG. 1, four types of tanks in which inks 9 having four colors being yellow (Y), magenta (M), cyan (C), and black (K) are respectively accommodated are provided. That is, an ink tank 3Y that accommodates a yellow ink 9, an ink tank 3M that accommodates a magenta ink 9, an ink tank 3C that accommodates a cyan ink 9, and an ink tank 3K that accommodates a black ink 9 are provided. The ink tanks 3Y, 3M, 3C, and 3K are arranged side by side in the housing 10 in the X-axis direction.

The ink tanks 3Y, 3M, 3C, and 3K have the same configuration except for the color of the ink 9 to be accommodated, and thus descriptions will be made in a state where the ink tanks 3Y, 3M, 3C, and 3K are collectively referred to as the ink tank 3 below.

Ink Jet Head 4

The ink jet head 4 is a head that ejects (discharges) ink droplets 9 onto recording paper P from a plurality of nozzles (nozzle holes Hn) described later, so as to perform recording (printing) of an image, characters, or the like. As the ink jet head 4, in this example, as illustrated in FIG. 1, four types of heads that ejects the four color inks 9 which are accommodated in the ink tanks 3Y, 3M, 3C, and 3K, respectively are provided. That is, an ink jet head 4Y that ejects the yellow ink 9, an ink jet head 4M that ejects the magenta ink 9, an ink jet head 4C that ejects the cyan ink 9, and an ink jet head 4K that ejects the black ink 9 are provided. The ink jet heads 4Y, 4M, 4C, and 4K are arranged side by side in the housing 10 in a Y-axis direction.

The ink jet heads 4Y, 4M, 4C, and 4K have the same configuration except for the color of the ink 9 to be used, and thus descriptions will be made in a state where the ink jet heads 4Y, 4M, 4C, and 4K are collectively referred to as the ink jet head 4 below. A detailed configuration example of the ink jet head 4 will be described later (FIGS. 2 to 5).

The ink supply tube 50 is a tube for supplying the ink 9 from the ink tank 3 into the ink jet head 4. The ink supply tube 50 is configured by a flexible hose, for example, having a flexibility allowing following of an operation of the scanning mechanism 6 described below.

Scanning Mechanism 6

The scanning mechanism 6 is a mechanism that performs scanning on the ink jet head 4 in a width direction (Y-axis direction) of recording paper P. As illustrated in FIG. 1, the scanning mechanism 6 includes a pair of guide rails 61*a* and 61*b* provided to extend in the Y-axis direction, a carriage 62 supported by the guide rails 61*a* and 61*b* to be movable, and a driving mechanism 63 that moves the carriage 62 in the Y-axis direction.

The driving mechanism 63 includes a pair of pulleys 631*a* and 631*b* disposed between the guide rails 61*a* and 61*b*, an endless belt 632 wound between the pulleys 631*a* and 631*b*, and a driving motor 633 that drives the pulley 631*a* to rotate. The four types of ink jet heads 4Y, 4M, 4C, and 4K described above are arranged side by side on the carriage 62 in the Y-axis direction.

A moving mechanism that relatively moves the ink jet head 4 and the recording paper P is configured by such a scanning mechanism 6 and the above-described transport mechanisms 2*a* and 2*b*.

B. Detailed Configuration of Ink Jet Head 4

A detailed configuration example of the ink jet head 4 will be described with reference to FIGS. 2 and 3.

Figure 2:
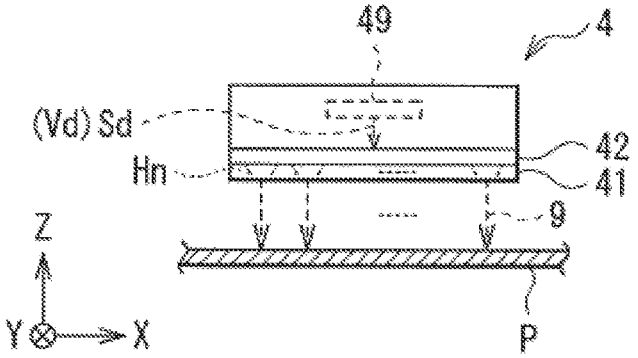
FIG. 2 is a schematic diagram illustrating the schematic configuration example of a liquid ejecting head illustrated in FIG. 1.

FIG. 2 schematically illustrates a schematic configuration example of the ink jet head 4. FIG. 3 is a block diagram illustrating the detailed configuration example of the ink jet head 4 illustrated in FIG. 2.

Figure 3:
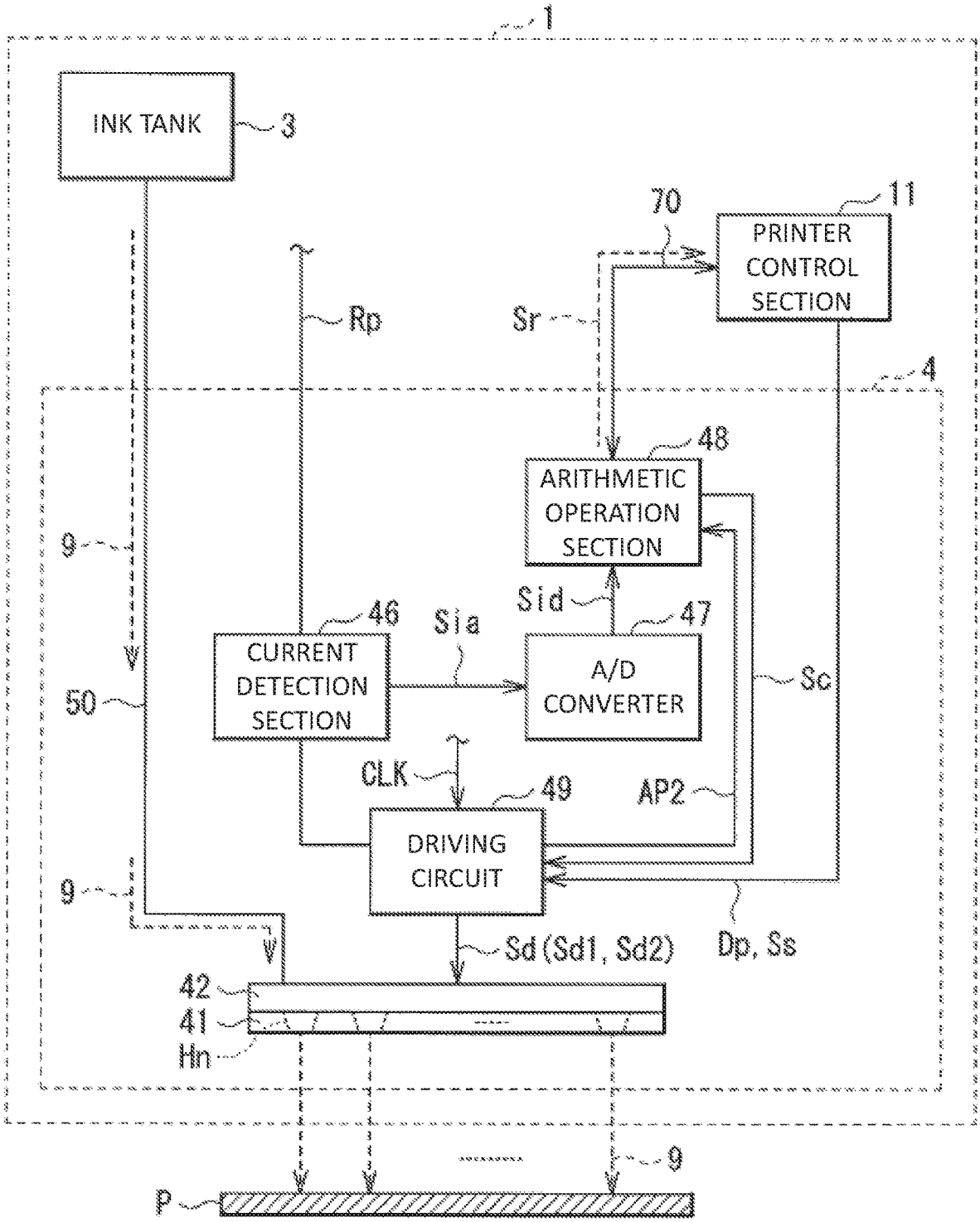
FIG. 3 is a block diagram illustrating a detailed configuration example of the liquid ejecting head illustrated in FIG. 2.

As illustrated in FIGS. 2 and 3, the ink jet head 4 includes a nozzle plate 41, an actuator plate 42, a current detection section 46, an A/D converter 47, an arithmetic operation section 48 and a driving circuit (driving section) 49.

The nozzle plate 41 and the actuator plate 42 correspond to a specific example of "an ejecting section" in the present disclosure.

Nozzle Plate 41

The nozzle plate 41 is a plate made of a film material such as polyimide or a metal material. As illustrated in FIGS. 2 and 3, the nozzle plate 41 includes a plurality of nozzle holes Hn that eject the ink 9 (see arrows of broken lines in FIGS. 2 and 3). The nozzle holes Hn are formed side by side at a predetermined interval in a straight line (in this example, in the X-axis direction). Each of the nozzle holes Hn corresponds to a specific example of "a nozzle" in the present disclosure.

Actuator Plate 42

The actuator plate 42 is a plate made of a piezoelectric material such as PZT (lead zirconate titanate), for example. A plurality of channels (not illustrated) are provided in the actuator plate 42. The channel is a portion functioning as a pressure chamber for applying pressure to the ink 9. The channels are arranged side by side to be parallel to each other at a predetermined interval. Each channel is formed by a drive wall (not illustrated) made of a piezoelectric material and has a recessed groove portion in a cross-sectional view.

A discharge channel for discharging the ink 9 and a dummy channel (non-discharge channel) for not discharging the ink 9 are provided in such channels. In other words, the discharge channel is filled with the ink 9, but the dummy channel is not filled with the ink 9. Each discharge channel communicates with the nozzle hole Hn in the nozzle plate 41, but each dummy channel does not communicate with the nozzle hole Hn. The discharge channel and the dummy channel are alternately arranged side by side in a predetermined direction.

A drive electrode (not illustrated) is provided on each of inner side surfaces facing each other of the drive wall. The driving electrode includes a common electrode provided on an inner side surface facing the discharge channel and an active electrode (individual electrode) on an inner side surface facing the dummy channel. The driving electrodes and a driving circuit in a drive substrate (not illustrated) are electrically connected to each other through a plurality of lead electrodes formed on a flexible substrate (not illustrated). Thus, a drive voltage Vd (driving signal Sd) described later is applied to each driving electrode from the driving circuit 49 described later through the flexible substrate.

Driving Circuit 49

The driving circuit 49 applies the drive voltage Vd (driving signal Sd) to the actuator plate 42 to expand or contract the discharge channel, and thus cause the actuator plate 42 to eject the ink 9 from each nozzle hole Hn (cause the actuator plate 42 to perform an ejection operation) (see FIGS. 2 and 3). That is, the driving circuit 49 drives the ejecting section (actuator plate 42 and nozzle plate 41) based on a printing driving signal Sd1 as the driving signal Sd, and thus the ink 9 is ejected from each nozzle hole Hn. The driving circuit 49 drives the ejecting section based on an inspection driving signal Sd2 as the driving signal Sd, in an inspection described later (inspection of the state of the ejecting section).

Here, the driving circuit 49 generates the printing driving signal Sd1 based on various types of data (signals) and the like transmitted from a printer control section 11 in the printer 1 (outside the ink jet head 4) (see FIG. 3). Specifically, the driving circuit 49 generates the printing driving signal Sd1 based on print data Dp and a discharge start signal Ss transmitted from the printer control section 11. The driving circuit 49 generates the inspection driving signal Sd2 based on an inspection control signal Sc output from the arithmetic operation section 48 described later.

The printer control section 11 performs various controls for a printing operation on recording paper P. Such a driving circuit 49 is configured, for example, using an application specific integrated circuit (ASIC).

Here, in the example in FIG. 3, the print data Dp and the discharge start signal Ss are exemplified as data (transmission data) to be transmitted from the printer control section 11 outside the ink jet head 4 to the inside (driving circuit 49) of the ink jet head 4. Each of the print data Dp and the discharge start signal Ss is transmitted by low voltage differential signaling (LVDS). In other words, the transmission data is data transmitted through a differential transmission path (high-speed differential transmission path). Thus, it is possible to perform high-speed transmission using a small amplitude signal, and the ability of removing common-mode noise is improved by using a differential transmission signal.

As illustrated in FIG. 3, a power supply path Rp for supplying power from the outside of the ink jet head 4 is connected to the driving circuit 49.

The power supply path Rp is a power supply path used when the printing driving signal Sd1 or the inspection driving signal Sd2 is generated. A bypass capacitor (not illustrated) for stably performing a printing operation and the like is connected to the power supply path Rp.

Current Detection Section 46, A/D Converter 47

As illustrated in FIG. 3, the current detection section 46 is disposed on the power supply path Rp and detects a current generated on the power supply path Rp. Examples of the current generated on the power supply path Rp includes current consumption occurring when the inspection driving signal Sd2 is used or a dark current generated in a state (standby state) in which the printing driving signal Sd1 and the inspection driving signal Sd2 are not output from the driving circuit 49. The current detection section 46 outputs a current signal Sia configured from an analog signal, as a detection result of such a current on the power supply path Rp. That is, the current detection section 46 acquires the current signal Sia as measurement data, based on the detection result of such a current. Such a current detection section 46 includes, for example, a current detection resistor element that performs current-voltage conversion, an amplifier circuit that amplifies a minute voltage generated between terminals of the resistor element, and a filter circuit that suppresses noise.

As illustrated in FIG. 3, the A/D converter 47 performs analog-digital (A/D) conversion of the current signal (analog signal) Sia output from the current detection section 46, so as to generate a current signal Sid configured from a digital signal.

Each of the current signals Sia and Sid corresponds to a specific example of "the measurement data" in the present disclosure.

Arithmetic Operation Section 48

The arithmetic operation section 48 performs various types of arithmetic operation processing based on the detection result (measurement data) of the current on the power supply path Rp in the current detection section 46. Specifically, the arithmetic operation section 48 performs both types of processing and the like being an inspection of the state of the above-described ejecting section and acquisition of a predetermined parameter (parameter relating to ejection of the liquid) described later, as such various types of arithmetic operation processing. The arithmetic operation section 48 transmits a notification of a result obtained by inspecting the state of such an ejecting section and a result obtained by a predetermined determination based on the parameter (for example, as described later, determination regarding validity of a setting parameter in the ink jet head 4) to the outside.

In detail, in the example in FIG. 3, the arithmetic operation section 48 performs the various types of arithmetic operation processing based on the current signal Sid output from the A/D converter 47. The arithmetic operation section 48 notifies the printer control section 11 on the outside of the ink jet head 4 of a result notification signal Sr as results of the above inspection and determination, through a serial communication line 70. Further, the arithmetic operation section 48 outputs an inspection control signal Sc being a control signal when the inspection driving signal Sd2 described later is generated, to the driving circuit 49 (see FIG. 3).

As illustrated in FIG. 3, the serial communication line 70 connects the arithmetic operation section 48 and the printer control section 11 to each other and is a communication line, for example, using an inter-integrated circuit ($I^2C$) communication or the like. For example, transmission and reception of, for example, the result (result notification signal Sr) of the inspection or the determination, a start of an inspection, or the like is performed through such the serial communication line 70. The inspection control signal Sc is supplied to the driving circuit 49 using a communication (low-speed communication in the ink jet head 4) having a speed lower than the speed in transmission through the above-described high-speed differential transmission path. Examples of such a low-speed communication include an $I^2C$ communication and a serial peripheral interface (SPI) communication.

Here, specific examples of contents of the inspection (inspection of the state of the ejecting section) include an inspection of the state of the nozzle plate 41, an inspection of the state of the above-described drive wall in the actuator plate 42, and an inspection of the filling state with the ink 9 in the above-described pressure chamber. In the embodiment, an inspection of a filling state with the ink 9 will be described below as an example of the inspection of the state of the ejecting section among the above inspections.

Specific examples of the parameter (parameters relating to ejection of the liquid) includes a natural vibration period (of the ink 9) in the ejecting section (above-described discharge channel). In the embodiment, descriptions will be made below by using the natural vibration period in the ejecting section as an example of such a parameter.

A period being ½ of such a natural vibration period of the ink 9 is referred to as an on-pulse peak (AP value). In other words, such a natural vibration period is defined as (2×AP value). In a case where a pulse width of the above-described driving signal Sd is set to the AP value, the ejection speed (discharge performance) of the ink 9 becomes the maximum when the ink (one droplet) 9 is normally discharged. That is, in order to obtain the maximum discharge performance, it is necessary that an acoustic wave propagating through the ink 9 in the discharge channel cause sonic resonance. Such an AP value is defined, for example, by the shape of the discharge channel, a physical property such as a specific gravity of the ink 9, and the like.

Such an arithmetic operation section 48 is configured using a digital arithmetic circuit such as a central processing unit (CPU), a field-programmable gate array (FPGA), and a digital signal processor (DSP), for example. Details of the various types of arithmetic operation processing in the arithmetic operation section 48 will be described later (FIGS. 4 to 9B).

Operation and Action and Effect

A. Basic Operation of Printer 1

In the printer 1, a recording operation (printing operation) of an image, a character, or the like is performed on recording paper P in a manner as follows. As an initial state, the inks 9 having the colors (four colors) corresponding to the four types of ink tanks 3 (3Y, 3M, 3C, and 3K) illustrated in FIG. 1, respectively, are sealed by the four types of ink tanks. A state where the ink jet head 4 is filled with the ink 9 in the ink tank 3 through the ink supply tube 50 is made.

In such an initial state, if the printer 1 is operated, the grid roller 21 in each of the transport mechanisms 2*a* and 2*b* rotates, and thus the recording paper P is transported between the grid roller 21 and the pinch roller 22 in a transport direction (X-axis direction) d. Simultaneous with such a transport operation, the driving motor 633 in the driving mechanism 63 rotates the pulleys 631*a* and 631*b* to operate the endless belt 632. Thus, while the carriage 62 is guided by the guide rails 61*a* and 61*b*, the recording paper P reciprocates in the width direction (Y-axis direction). At this time, the four colors of inks 9 are appropriately discharged onto the recording paper P by the ink jet heads 4 (4Y, 4M, 4C, and 4K), and, in this manner, the recording operation of an image, a character, or the like on the recording paper P is performed.

B. Detailed Operation in Ink Jet Head 4

A detailed operation of the ink jet head 4 (ejection operation of the ink 9) will be described. That is, in the ink jet head 4, an ejection operation of the ink 9 using a shear mode is performed in a manner as follows.

Firstly, the driving circuit 49 applies a drive voltage Vd (printing driving signal Sd1 as the driving signal Sd) to the above-described driving electrode (common electrode and active electrode) in the actuator plate 42 (see FIGS. 2 and 3). Specifically, the driving circuit 49 applies the drive voltage Vd to each driving electrode disposed on a pair of drive walls that define the above-described discharge channel. Thus, each of the pair of drive walls deforms to protrude toward the dummy channel adjacent to the discharge channel.

At this time, the drive wall deforms to be bent in a V shape using an intermediate position in a depth direction of the drive wall as the center. The discharge channel is deformed to swell, by such bending deformation of the drive wall. As described above, the pair of drive wall deform to be bent by a piezoelectric thickness-shear effect, and thus the volume of the discharge channel increases. The ink 9 is guided into the discharge channel by increasing the volume of the discharge channel.

Then, the ink 9 guided into the discharge channel in this manner propagates in the discharge channel in a form of a pressure wave. The drive voltage Vd to be applied to the driving electrode becomes 0 (zero) V at a timing at which the pressure wave reaches the nozzle hole Hn of the nozzle plate 41 (or reaches the vicinity of the nozzle hole Hn). Thus, the drive wall is restored from the state of bending deformation, and as a result, the volume of the discharge channel, which has increased is brought back to the original again.

In this manner, in the process of the volume of the discharge channel being brought back to the original, pressure in the discharge channel increases, and thus the ink 9 in the discharge channel is pressurized. As a result, an ink droplet 9 is discharged to the outside (toward recording paper P) through the nozzle hole Hn (see FIGS. 2 and 3). The ejection operation (discharge operation) of the ink 9 in the ink jet head 4 is made in this manner. As a result, the recording operation (printing operation) of an image, a character, or the like on the recording paper P is performed.

C. Arithmetic Operation Processing in Arithmetic Operation Section 48

Next, various types of arithmetic operation processing (various types of processing such as the inspection of the state of the ejecting section and acquisition of the parameter, which relates to the ejection of the ink 9) described above in the arithmetic operation section 48 will be described in detail with reference to FIGS. 1 to 3 and FIGS. 4 to 9B.

C-1. Regarding Inspection Processing

Firstly, inspection processing and the like regarding the state of the ejecting section in a printer including a general ink jet head will be described.

Firstly, when the ink jet head is filled with an ink from the ink tank, normally, a method of performing a practical printing operation is employed in order to check whether or not all pressure chambers are filled with the ink. In this method, since the performing practical printing operation is intended, the ink, a recording medium, and the like are consumed until filling with the ink is completed.

Examples of a method of checking whether or not all pressure chambers are filled with the ink, in advance, include a method of measuring current when the ejecting section is driven and determining a filling state with the ink from a measurement result of the current. Even in the inspection processing (inspection processing for the state of the ejecting section) in the embodiment, which will be described below, the filling state with the ink 9 is inspected using the measurement result of such a current.

C-2. Details of Arithmetic Operation Processing in Embodiment

Figure 4:
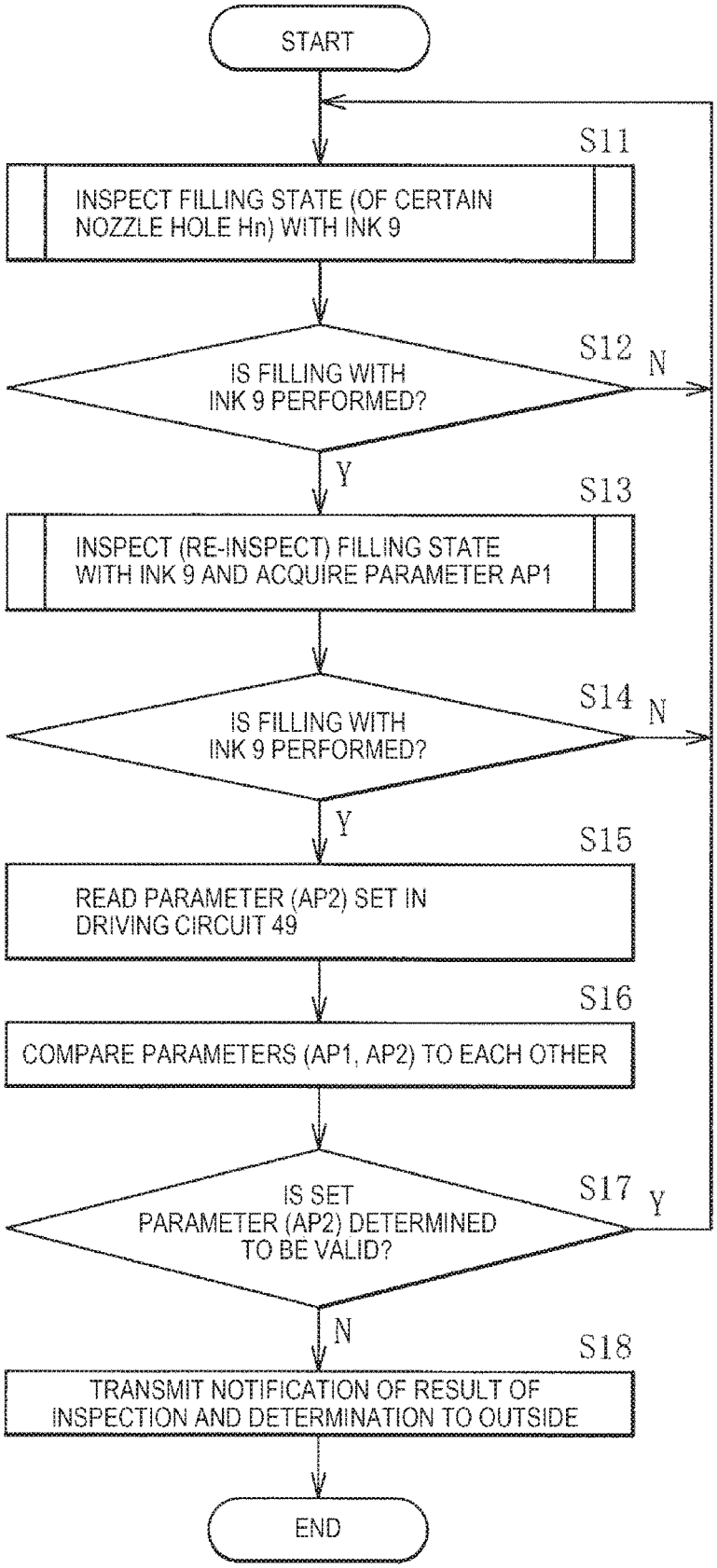
FIG. 4 is a flowchart illustrating an example of arithmetic operation processing (various types of processing in an arithmetic operation section) according to the embodiment.
Figure 5:
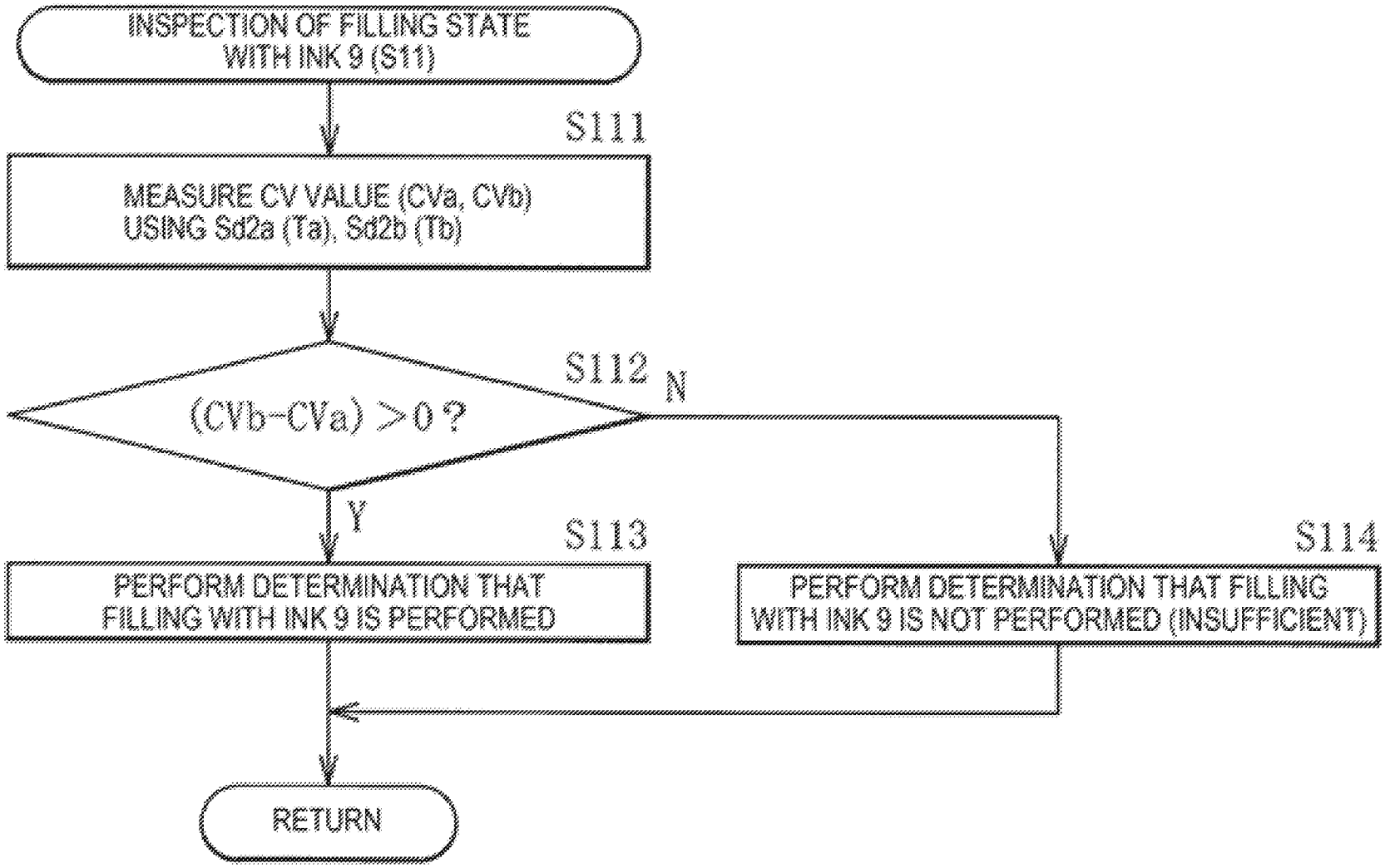
FIG. 5 is a flowchart illustrating an example of detailed processing in Step S11 illustrated in FIG. 4.
Figure 6:
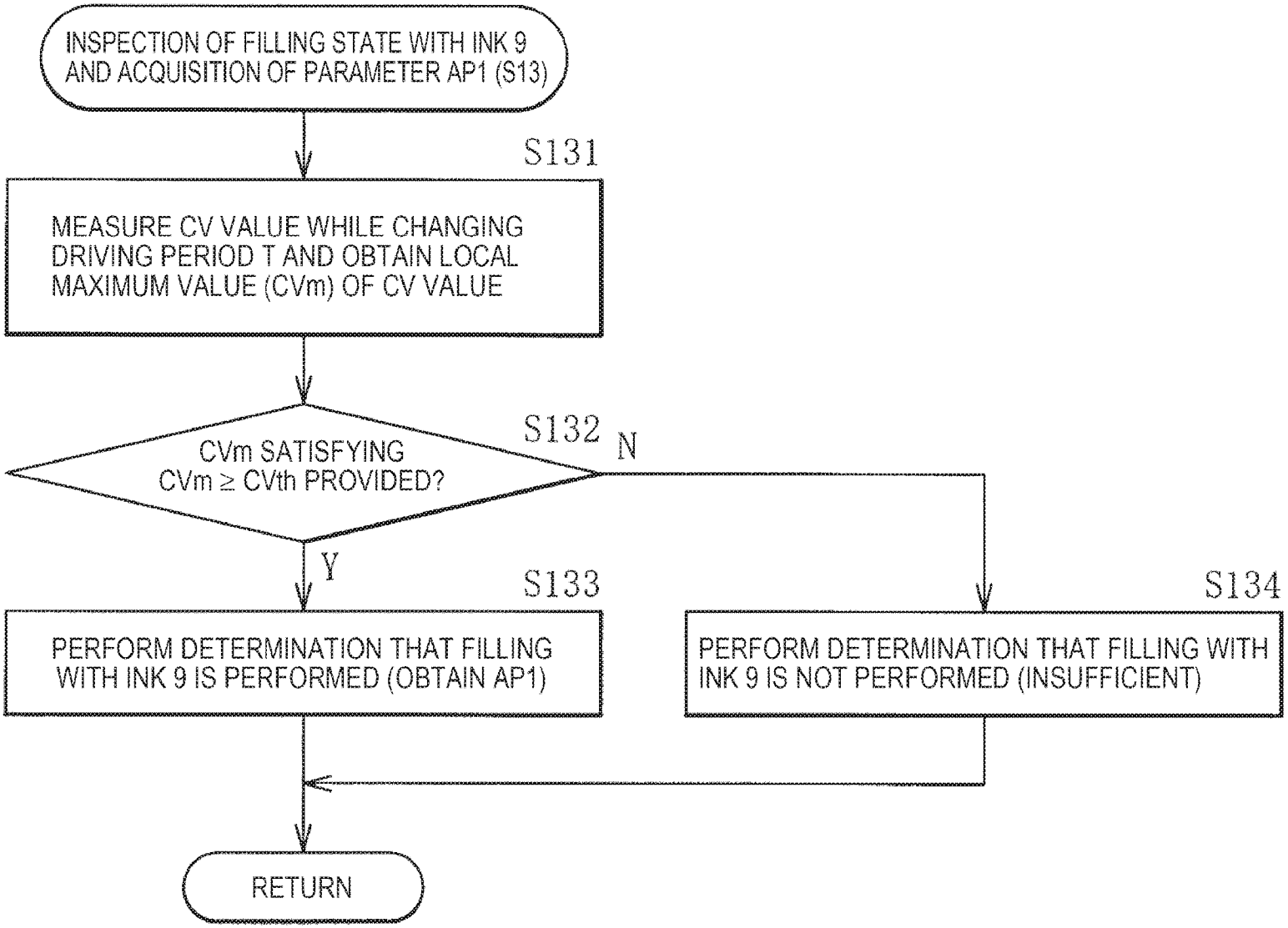
FIG. 6 is a flowchart illustrating an example of detailed processing in Step S13 illustrated in FIG. 4.

Here, FIG. 4 is a flowchart illustrating an example of arithmetic operation processing (various types of processing in the arithmetic operation section 48) according to the embodiment. FIG. 5 is a flowchart illustrating an example of detailed processing in Step S11 which will be described later and is illustrated in FIG. 4. FIG. 6 is a flowchart illustrating an example of detailed processing in Step S13 which will be described later and is illustrated in FIG. 4.

Figure 7:
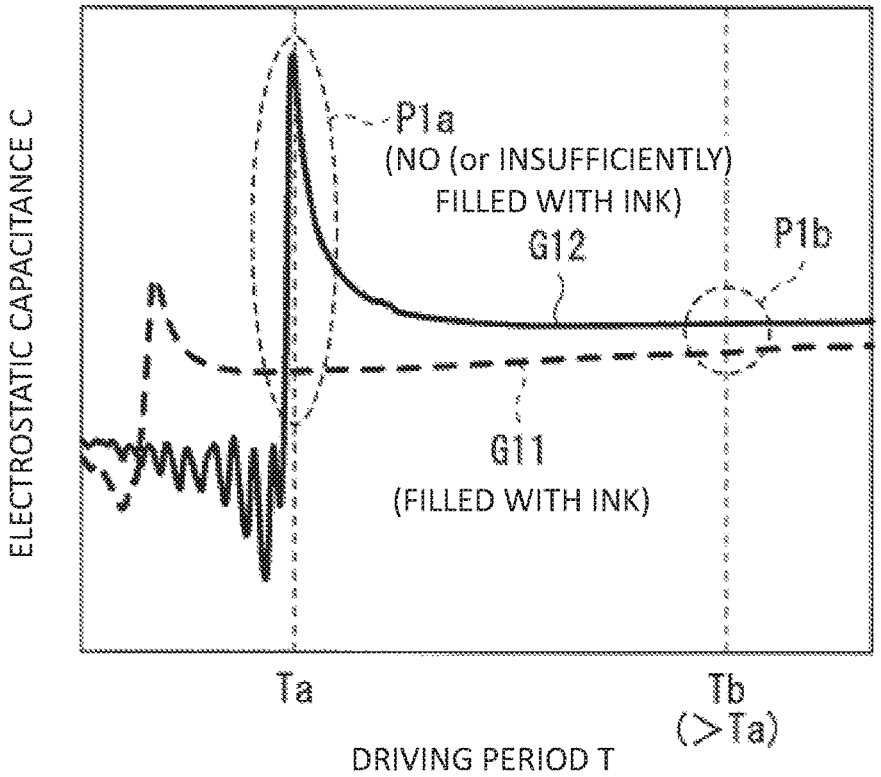
FIG. 7 is a diagram illustrating an example of a correspondence relationship between a drive cycle and electrostatic capacitance.
Figure 8:
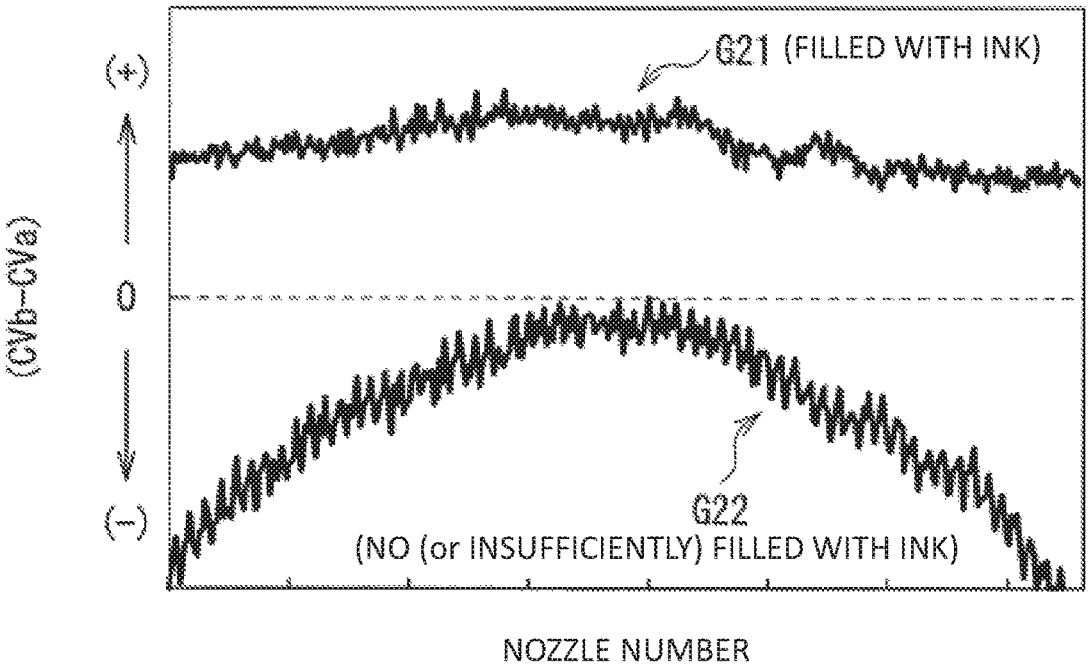
FIG. 8 is a diagram illustrating an example of a correspondence relationship between a nozzle number and a difference value of a CV value.
Figure 9A:
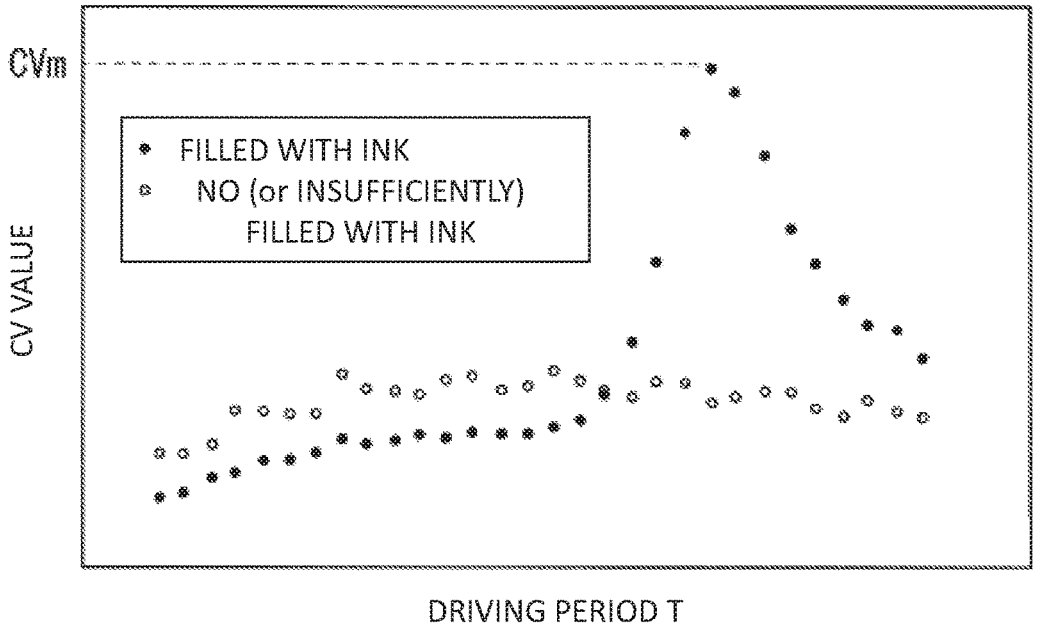
FIG. 9A is a diagram illustrating an example of a correspondence relationship between the drive cycle and the CV value.
Figure 9B:
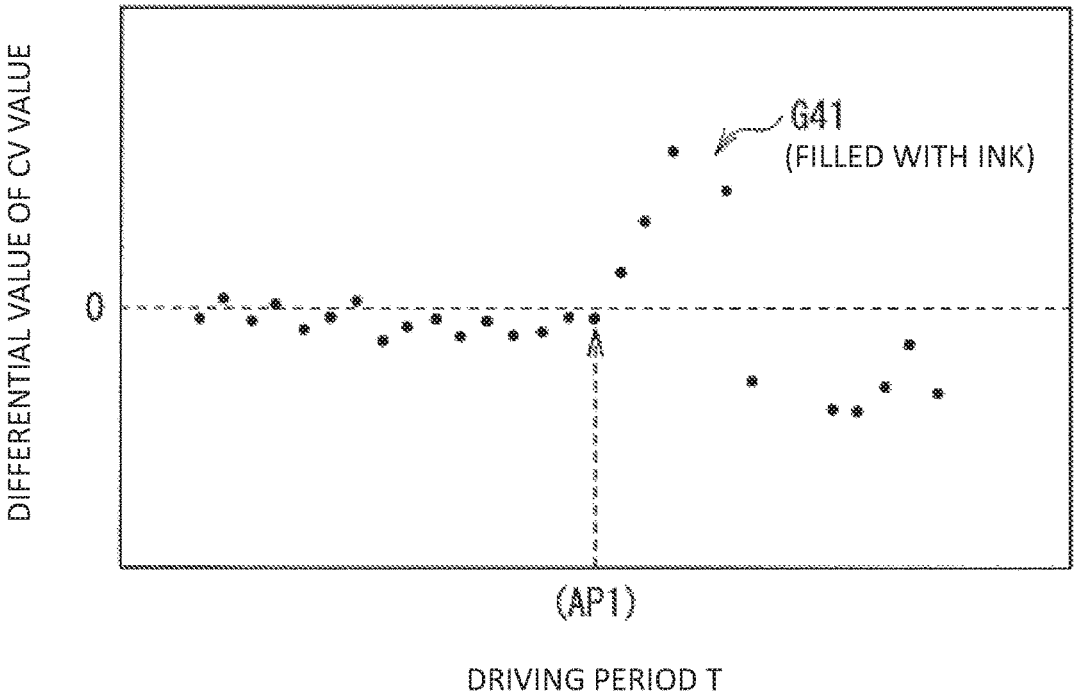
FIG. 9B is a diagram illustrating an example of a correspondence relationship between the drive cycle and a differential value of the CV value.

FIG. 7 is a diagram illustrating an example of a correspondence relationship between a drive cycle T in the above-described inspection driving signal Sd2 and electrostatic capacitance C described below. FIG. 8 is a diagram illustrating an example of a correspondence relationship between a nozzle number assigned to each of the plurality of nozzle holes Hn in the nozzle plate 41 and a difference value (CVb−CVa) of a CV value described below. FIG. 9A is a diagram illustrating an example of a correspondence relationship between the drive cycle T and the CV value. FIG. 9B is a diagram illustrating a correspondence relationship between the drive cycle T and a differential value of the CV value.

The drive cycle T corresponds to a specific example of "a period" in the present disclosure.

Step S11

In a series of arithmetic operation processing illustrated in FIGS. 4 to 6, the arithmetic operation section 48 firstly inspects the filling state of a nozzle hole Hn with the ink 9 among the plurality of nozzle holes Hn (Step S11 in FIG. 4).

Specifically, firstly, the arithmetic operation section 48 acquires plural pieces of measurement data (CV values) using a plurality of inspection driving signals Sd2 having drive cycles T different from each other. In detail, in the example illustrated in FIGS. 5 and 7, the arithmetic operation section 48 measures two CV values (CVa and CVb) using two inspection driving signals Sd2 (having two drive cycles T) which are an inspection driving signal Sd2*a* having a drive cycle T being Ta and an inspection driving signal Sd2*b* having a drive cycle T being Tb (>Ta) (Step S111 in FIG. 5). Examples of the drive cycle Tb include a value (Tb=2×Ta) being two times the drive cycle Ta.

Here, a stable drive current I generated when the ejecting section (actuator plate 42 and nozzle plate 41) is driven is defined by Expression (1) using the drive cycle T.

$$I=(C\times V)/T \tag{1}$$

(C: electrostatic capacitance of the ejecting section, and V: amplitude (drive voltage Vd) of the driving signal Sd)

In Expression (1), if the amplitudes V in the drive cycles T being Ta and Tb (=2×Ta) are set to be equal to each other, in a case where the value of the electrostatic capacitance C in each of the nozzle holes Hn is constant, the followings are performed. That is, the drive cycle I being Ia in the drive cycle Ta is two times the drive cycle I being Ib in the drive cycle Tb, that is, (Ia=2×Ib) is satisfied.

Expression (1) is transformed into Expression (2) in order to remove a difference of the value of the drive current I, which is caused by such a difference of the drive cycle I. The value of the left side (C×V) in Expression (2) is defined as the CV value, and the CV values in the drive cycles T being Ta and Tb are set as CVa and CVb, respectively.

$$(C\times V)=(I\times T) \tag{2}$$

Here, in the example of the correspondence relationship between the drive cycle T and the electrostatic capacitance C, which is illustrated in FIG. 7, the followings are performed at the nozzle hole Hn (see a graph indicated by the reference sign G11 illustrated by a broken line) in a case where filling with the ink 9 is performed (case of "filling with ink: provided") and at the nozzle hole Hn (see a graph indicated by the reference sign G12 illustrated by a solid line) in a case where filling with the ink 9 is not performed. "The case where filling with the ink 9 is not performed" includes not only a case the filling with the ink 9 is not performed at all, but also a case where filling with the ink 9 is insufficiently performed (for example, state where the ink 9 contains bubbles of the degrees causing an influence on discharge), as described in parentheses in FIG. 7. This is similarly applied to the following descriptions. In the vicinity of the drive cycle T being Ta, as indicated by the reference sign P1*a*, the electrostatic capacitance C in a case where filling with the ink 9 is not performed has a much larger value than the electrostatic capacitance in a case where filling with the ink 9 is performed. In the vicinity of the drive cycle T being Tb(>Ta), as indicated by the reference sign P1*b*, the electrostatic capacitance C in a case where filling with the ink 9 is not performed has a value substantially equal to a value in a case where filling with the ink 9 is performed. In both cases, the difference value of the electrostatic capacitance C is very small. In other words, the drive cycles Ta and Tb are selected so as to show such characteristics of the electrostatic capacitance C in a case where filling with the ink 9 is not performed and in a case where filling with the ink 9 is performed.

For example, as illustrated in FIG. 8, the difference value (CVb−CVa) between the CV values (CVa and CVb) in such drive cycles Ta and Tb are as follows from the above characteristics of the electrostatic capacitance C in a case where filling with the ink 9 is not performed and in a case where filling with the ink 9 is performed. That is, the difference value (CVb−CVa) of the CV value is a positive (+) value in the nozzle hole Hn (see the graph indicated by the reference sign G21) in a case where filling with the ink 9 is performed. The difference value (CVb−CVa) of the CV value is a negative (−) value in the nozzle hole Hn (see the graph indicated by the reference sign G22) in a case where filling with the ink 9 is not performed. Thus, as described below, the arithmetic operation section 48 inspects the filling state with the ink 9 by using whether such a difference value (CVb−CVa) of the CV value is a positive value or a negative value.

That is, firstly, the arithmetic operation section 48 determines whether such a difference value (CVb−CVa) of the CV value is a positive value, that is, whether or not (CVb−CVa)>0 is satisfied (Step S112 in FIG. 5). Here, in a case where (CVb−CVa)>0 is satisfied (the difference value is a positive value) (Y in Step S112), as described above, the arithmetic operation section 48 determines that filling with the ink 9 is performed (Step S113). In a case where (CVb−CVa)>0 is not satisfied (the difference value is a negative value) (N in Step S112), as described above, the arithmetic operation section 48 determines that filling with the ink 9 is not performed (or is not sufficient) (Step S114).

Step S12

The arithmetic operation section 48 determines whether the nozzle hole Hn as the current inspection target is filled with the ink 9 (Step S12 in FIG. 4), by such an inspection of Step S11 (S111 to S114). In a case where it is determined that the filling with the ink 9 is not performed (or is not sufficient) (N in Step S12), the process returns to Step S11, and the filling state with the ink 9 is inspected for the nozzle hole Hn as the next inspection target.

Step S13

In a case where it is determined that filling with the ink 9 is performed (Y in Step S12), the arithmetic operation section 48 inspects (re-inspects) the filling state with the ink 9 and acquires the AP value (AP1) as the above-described parameter (parameter relating to ejection of the liquid) (Step S13).

Specifically, firstly, the arithmetic operation section 48 measures the CV value while the drive cycle T is changed (for example, decreases), and the maximum value CVm among the CV values (Step S131 in FIG. 6).

Here, in the example of the correspondence relationship between the drive cycle T and the CV value, which is illustrated in FIG. 9A, in a case where filling with the ink 9 is performed (see a graph indicated by black circles) and in a case where filling with the ink 9 is not performed see a graph indicated by white circles), the followings are performed. That is, in a case where filling with the ink 9 is not performed, even though the drive cycle T changes, the CV value hardly changes (shows substantially flat change characteristics). In a case where filling with the ink 9 is performed, if the drive cycle T changes, the CV value shows the maximum value CVm in a certain drive cycle T (shows change characteristics having the maximum value CVm). Thus, as described below, the arithmetic operation section 48 inspects (re-inspects) the filling state of the ink 9, using whether or not the maximum value CVm which is equal to or greater than a predetermined value (threshold value CVth) is provided.

In a case where filling with the ink 9 is performed, such a maximum value CVm is generated by acoustic oscillation in the above-described pressure chamber (discharge channel) and is associated with the above-described natural vibration frequency (AP value). Thus, a frequency region in which the maximum value CVm is shown is predicted to some extents if the pressure chamber of the ink jet head 4 is known. Thus, it is possible to narrow the range of the drive cycle T in measurement.

For the reason, the arithmetic operation section 48 determines whether or not the maximum value CVm satisfying (maximum value CVm≥threshold value CVth) is provided (Step S132 in FIG. 6). In a case where it is determined that the maximum value CVm satisfying (maximum value CVm≥threshold value CVth) (Y in Step S132), the arithmetic operation section 48 determines that filling with the ink 9 has been performed, and obtains the AP value (AP1) as the above-described parameter (Step S133). In a case where it is determined that there is no maximum value CVm satisfying (maximum value CVm≥threshold value CVth) (N in Step S132), the arithmetic operation section 48 determines that filling with the ink 9 is not performed (or is not sufficient) (Step S134). That is, in this case, the AP value (AP1) as the above-described parameter is not obtained.

Here, the AP value (AP1) may be obtained using a waveform of the graphs illustrated in FIGS. 9A and 9B, for example. Specifically, for example, a period (zero cross point) corresponding to the drive cycle T in which the differential value of the CV value is 0, which is illustrated in FIG. 9B, may be obtained as the AP value (AP1). The embodiment is not limited to such a method, and the AP value (AP1) may be obtained by other methods.

Step S14

The arithmetic operation section 48 determines whether the nozzle hole Hn as the current inspection target is filled with the ink 9 (Step S14 in FIG. 4), by such an inspection (re-inspection) of Step S13 (S131 to S134). In a case where it is determined that the filling with the ink 9 is not performed (or is not sufficient) (N in Step S14), the process returns to Step S11, and the filling state with the ink 9 is inspected for the nozzle hole Hn as the next inspection target.

Step S15 to S17

In a case where it is determined that filling with the ink 9 is performed (Y in Step S14), the arithmetic operation section 48 reads the parameter (setting parameter relating to the ejection of the ink 9) set in the driving circuit 49 (Step S15). In the embodiment, as an example of such a setting parameter, the above-described AP value (AP2) is set to be read from the driving circuit 49 (see FIG. 3).

The arithmetic operation section 48 compares the AP value (AP1) being the parameter (acquisition parameter) obtained (based on the CV value) in Step S13 (S133) and the AP value (AP2) as the setting parameter read in Step S15 to each other (Step S16). That is, the two parameters (AP1 and AP2) are compared to each other for determination whether or not the two parameters are equal to each other, for example.

The arithmetic operation section 48 performs determination for validity of the setting parameter (AP2) in the driving circuit 49 based on the comparison result in Step S16 (for example, as described above, determination of whether or not AP2 is equal to AP1). Specifically, the arithmetic operation section 48 determines whether or not determination that the setting parameter (AP2) is valid is obtained (Step S17).

Here, in a case where a determination result that the setting parameter (AP2) is valid (for example, AP2 is equal to AP1) is obtained (Y in Step S17), the process returns to Step S11. The filling state with the ink 9 is inspected for the nozzle hole Hn as the next inspection target.

Step S18

In a case where a determination result that the setting parameter (AP2) is not valid (for example, AP2 is not equal to AP1) is obtained (N in Step S17), the followings are performed. That is, in this case, the arithmetic operation section 48 transmits a notification of the result obtained by inspecting the filling state with the ink 9 in Steps S11 and S13 and the result obtained by determination in Step S17, to the outside (printer control section 11) of the ink jet head 4 by using the above-described result notification signal Sr (Step S18). Specifically, as the result of the determination in Step S17, for example, the printer control section 11 is notified of the determination result that the setting parameter (AP2) in the driving circuit 49 is not valid (error notification).

Then, a series of arithmetic operation processing illustrated in FIGS. 4 to 6 is ended.

C-3. Action and Effect

In this manner, in the embodiment, both the inspection of the state of the above-described ejecting section and the acquisition of the parameter relating to the ejection of the ink 9 are performed based on the measurement data obtained based on the detection result of the current flowing on the power supply path Rp connected to the driving circuit 49.

In this manner, firstly, the above inspection is performed by using only the measurement data based on the detection result of the current flowing on the power supply path Rp, and then the followings are performed. That is, it is possible to realize the inspection with a simple configuration in comparison to, for example, a case where the inspection is performed using the individual voltage measurement result on the path of each of the plurality of nozzle holes Hn with the driving circuit 49 (Comparative Example 1). Since both such an inspection and the acquisition of the parameter are performed using the measurement data, separately to the inspection configuration, various operations are realized with a common configuration, differing from a case (Comparative Example 2) in which a configuration for acquiring the parameter is provided. For the reasons, in the embodiment, it is possible to improve the convenience in the ink jet head 4 in comparison to such comparative examples 1 and 2, and the like.

As described above, in the embodiment, since the inspection is performed only by using the measurement data based on the detection result of the current, it is possible to realize cost reduction in comparison to Comparative Example 1, for example.

In the embodiment, it is possible to obtain change characteristics suitable for both the inspection relating to the filling state with the ink 9 and the acquisition of the parameters, using the plural pieces of measurement data obtained by using the plurality of inspection driving signals Sd2 having different drive cycles T. Thus, it is possible to easily perform the inspection of the filling state with the ink 9 and the acquisition of the parameter and to further improve the convenience.

Further, in the embodiment, since the filling state with the ink 9 is inspected by determining whether or not the maximum value (CVm) which is equal to or greater than the threshold value CVth in the plural pieces of measurement data (CV values) is provided, the followings are performed. That is, for example, even though complicated arithmetic operation processing, observation of a high-speed electrical response, or the like is not performed, it is possible to realize the inspection of the filling state of the ink 9. As a result, it is possible to further improve the convenience.

In the embodiment, it is possible to improve accuracy of such an inspection by inspecting the filling state with the ink 9 based on the difference value between the plural pieces of measurement data (CV values). As a result, it is possible to further improve the convenience.

In the embodiment, since the natural vibration period (2×AP value) in the ejecting section is acquired based on the measurement data (CV value), it is possible to easily acquire such a natural vibration period in the ink jet head 4. Thus, in the ink jet head 4, for example, it is possible to easily perform the determination and the like of the validity of the printing driving signal Sd1. As a result, it is possible to further improve the convenience.

Further, in the embodiment, determination for the validity of the setting parameter (AP value) set in the ink jet head 4 (driving circuit 49) is further performed, and thus the follows are performed. That is, it is possible to recognize the validity of such a setting parameter in advance, and to cause the user to adjust the setting parameter, for example. As a result, it is possible to further improve the convenience and to improve image quality (printing quality) in ejection of the ink 9.

In addition, in the embodiment, a notification of the result obtained by the inspection and the result obtained by a predetermined determination (for example, a result obtained by determination for the validity of the setting parameter) based on the parameter are transmitted to the outside of the ink jet head 4 (printer control section 11). Thus, the follows are performed. That is, it is possible to cause the user to easily recognize the results obtained by the inspection and the determination. As a result, it is possible to further improve the convenience.

2. MODIFICATION EXAMPLE

Next, modification examples (Modification Examples 1 to 3) of the embodiment will be described. In the following, the same components as those in the embodiment will be denoted by the same reference signs, and description thereof will be omitted as appropriate.

Modification Example 1

Figure 10:
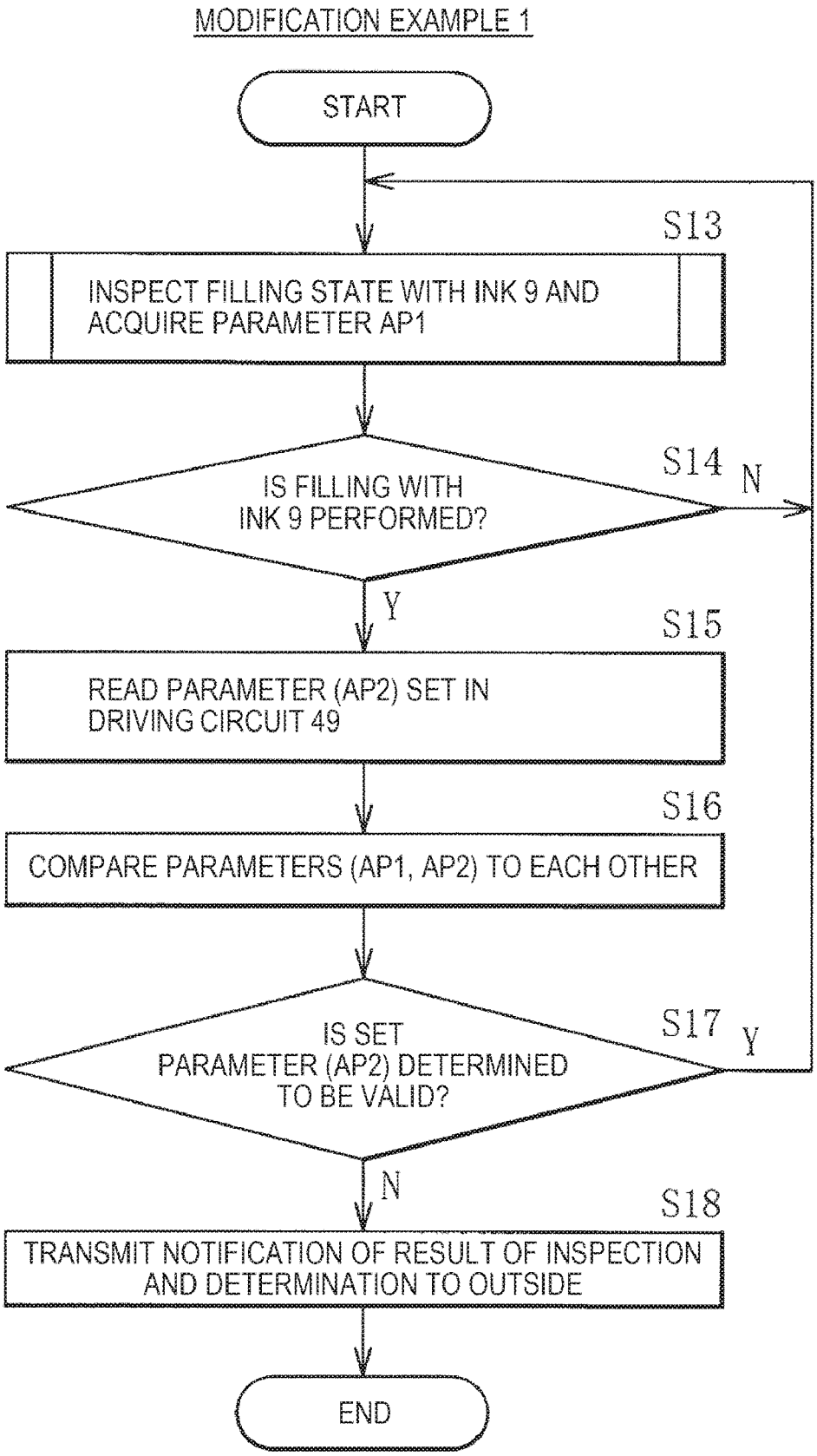
FIG. 10 is a flowchart illustrating an example of arithmetic operation processing according to Modification Example 1.

FIG. 10 is a flowchart illustrating an example of arithmetic operation processing (various types of processing in the arithmetic operation section 48) according to Modification Example 1.

In arithmetic operation processing in Modification Example 1 illustrated in FIG. 10, the processes of Steps S11 and S12 are omitted (not performed), and only the processes of Steps S13 to S18 are performed, in the arithmetic operation processing in the embodiment illustrated in FIG. 4. That is, in the arithmetic operation processing in Modification Example 1, the inspection of the filling state with the ink 9 in Step S11 is not performed, and only the inspection of the filling state with the ink 9 in Step S13 is performed.

Even in the above-described Modification Example 1, similar to the embodiment, both the inspection of the state of the above-described ejecting section and the acquisition of the parameter relating to the ejection of the ink 9 are performed based on the measurement data obtained based on the detection result of the current flowing on the power supply path Rp. Thus, even in Modification Example 1, it is basically possible to obtain similar effects by actions similar to those in the embodiment.

Modification Example 2

Figure 11:
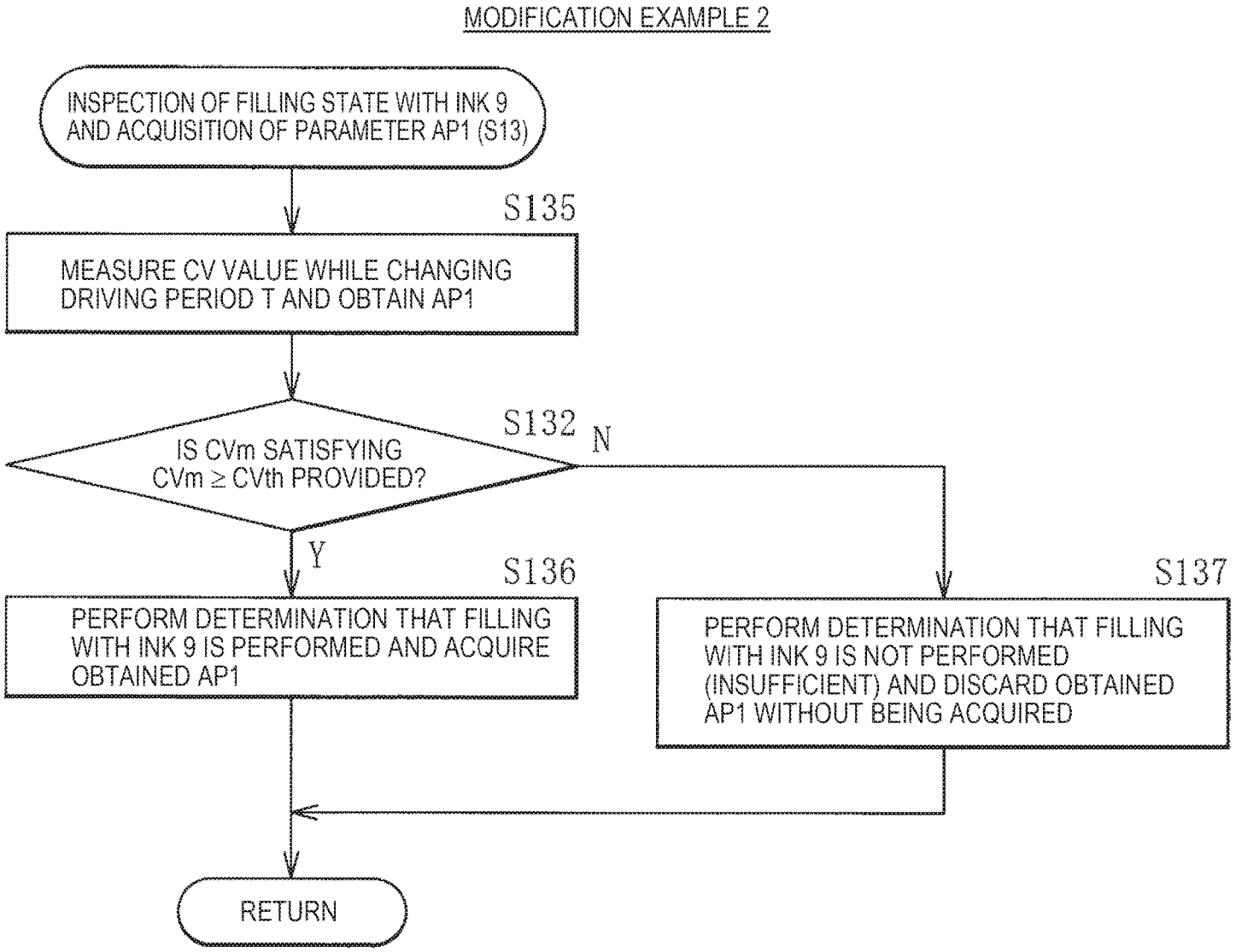
FIG. 11 is a flowchart illustrating an example of arithmetic operation processing (detailed processing in Step S13 illustrated in FIG. 4) according to Modification Example 2.

FIG. 11 is a flowchart illustrating an example of arithmetic operation processing (detailed processing in Step S13 illustrated in FIG. 4) according to Modification Example 2.

In arithmetic operation processing in Modification Example 2 illustrated in FIG. 11, the processes of Steps S135, S136, and S137 are performed instead of the processes of Steps S131, S133, and S134 in the arithmetic operation processing in the embodiment illustrated in FIG. 6.

Specifically, in Step S135, the arithmetic operation section 48 measures the CV value while the drive cycle T changes in the inspection driving signal Sd2, and obtains the AP value (AP1) as the above-described parameter.

In Step S136 (case of Y in Step S132), the arithmetic operation section 48 determines that filling with the ink 9 is performed, and acquires the AP value (AP1) obtained in Step S135. In Step S137 (case of N in Step S132), the arithmetic operation section 48 determines that filling with the ink 9 is not performed (or insufficient), and discards the AP value (AP1) obtained in Step S135 without being acquired. That is, in this case, the AP value (AP1) as the above-described parameter is not acquired in the arithmetic operation section 48.

As described above, in the arithmetic operation processing in Modification Example 2, differing from the arithmetic operation processing (FIG. 6) in the embodiment, the AP value (AP1) as the above-described parameter is obtained in advance before the filling state with the ink 9 is determined. Even in such Modification Example 2, it is basically possible to obtain similar effects by actions similar to those in the embodiment.

Modification Example 3

In the embodiments and Modification Examples 1 and 2 described above, the natural vibration period (2×AP value) in the ejecting section is described as an example of the above-described parameter (parameter relating to ejection of the liquid). On the contrary, in Modification Example 3 described below, the drive voltage Vd (amplitude value) in the printing driving signal Sd1 will be described as another example of such a parameter.

Figure 12A:
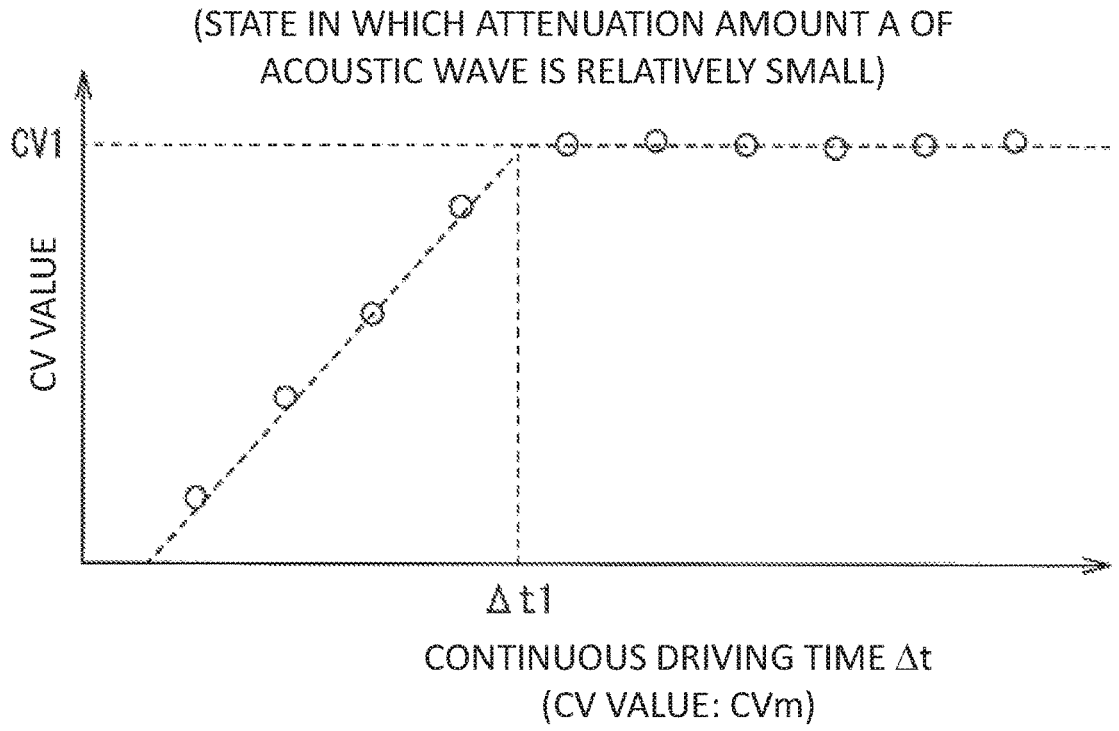
FIG. 12A is a diagram illustrating an example of a correspondence relationship between a continuous driving time and the CV value according to Modification Example 3.
Figure 12B:
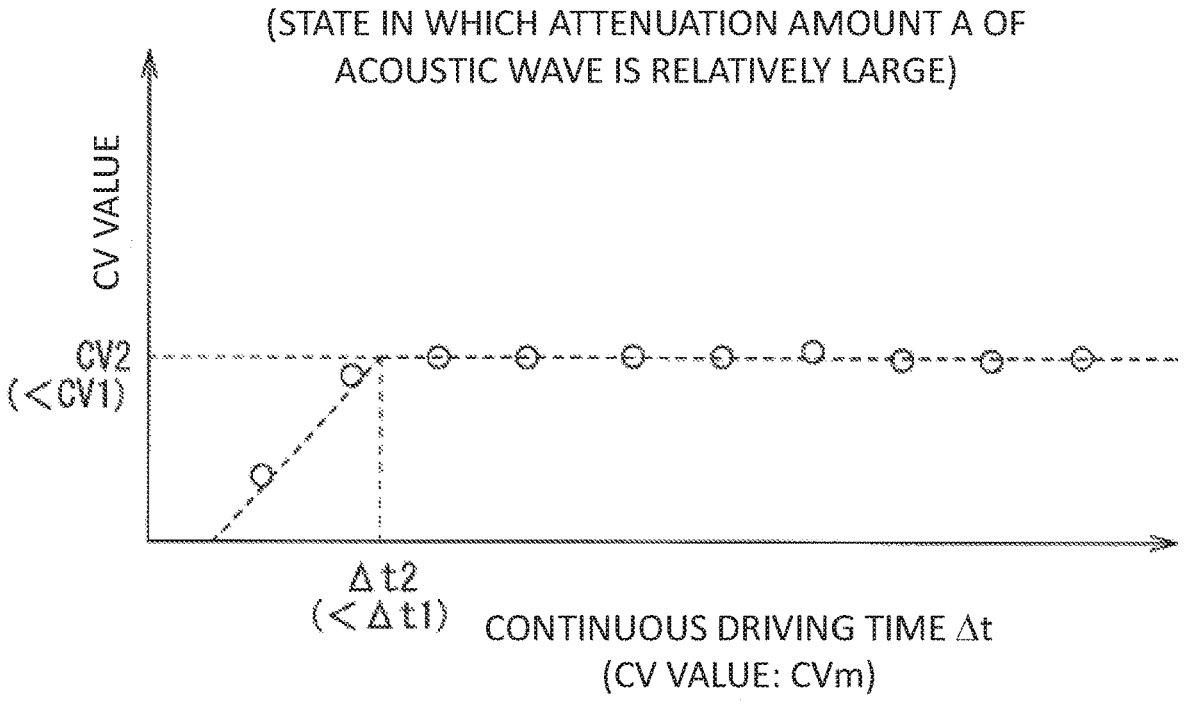
FIG. 12B is a diagram illustrating another example of a correspondence relationship between a continuous driving time and the CV value according to Modification Example 3.

FIGS. 12A and 12B illustrate an example of the correspondence relationship between the continuous driving time Δt and the CV value, according to Modification Example 3. Specifically, FIG. 12A illustrates an example of the correspondence relationship between the continuous driving time Δt and the CV value in a state where an attenuation amount A of an acoustic wave generated in the ink 9 is relatively small. FIG. 12B illustrates an example of the correspondence relationship between the continuous driving time Δt and the CV value in a state where the attenuation amount A of the acoustic wave generated in the ink 9 is relatively large. FIGS. 12A and 12B illustrate the correspondence relationship between a driving time (continuous driving time Δt) and the CV value in a state where continuous driving is performed on the ejecting section in the drive cycle T in which the CV value is the maximum value CVm described above.

Firstly, in a case where the attenuation amount A of the acoustic wave generated in the ink 9 is relatively large, the value of the drive voltage Vd in the printing driving signal Sd1 is required to increase. Thus, if the attenuation amount A is measured, it is possible to set the drive voltage Vd in the printing driving signal Sd1 to be an appropriate (optimum) value. Here, in order to measure such an attenuation amount A, for example, a time until a resonance phenomenon occurring in the ink 9 becomes stable may be measured.

Specifically, for example, as illustrated in FIG. 12A, the correspondence relationship between the continuous driving time Δt and the CV value is as follows in the state where the attenuation amount A of the acoustic wave generated in the ink 9 is relatively small. That is, the CV value increases as the continuous driving time Δt increases in a term of the continuous driving time Δt<Δt1. The CV value is substantially constant (CV value=CV1) regardless of the value of the continuous driving time Δt in a term of the continuous driving time Δt≥Δt1. That is, in the state where the attenuation amount A is relatively small, which is illustrated in FIG. 12A, if the continuous driving is performed during a period equal to or longer than Δt1, a stable resonance state is obtained.

For example, as illustrated in FIG. 12B, in the state where the attenuation amount A of the acoustic wave generated in the ink 9 is relatively large, the correspondence relationship between the continuous driving time Δt and the CV value is as follows. That is, in a term of the continuous driving time Δt<Δt2 (Δt2<Δt1), the CV value increases as the continuous driving time Δt increases. In a term of the continuous driving time Δt≥Δt2, the CV value is substantially constant (CV value=CV2 (<CV1)) regardless of the value of the continuous driving time Δt. That is, in the state where the attenuation amount A is relatively large, which is illustrated in FIG. 12B, the continuous driving time Δt is set to Δt2 being shorter than Δt1 in a case of FIG. 12A, and a stable resonance state is obtained. This shows that, in the state where the attenuation amount A is relatively large, the resonance state becomes stable earlier than the state where attenuation amount A is relatively small.

In this manner, since the continuous driving time Δt until the CV value becomes substantially constant is obtained, it is possible to measure the attenuation amount A of the acoustic wave generated in the ink 9 and to set the drive voltage Vd in the printing driving signal Sd1 to an appropriate value.

Even in such Modification Example 3, it is basically possible to obtain similar effects by actions similar to those in the embodiment.

In particular, in Modification Example 3, as described above, the drive voltage Vd in the printing driving signal Sd1 is acquired based on the measurement data (CV value) as described above, and thus the following are performed. That is, in the ink jet head 4, for example, it is possible to easily perform determination of the validity of such a drive voltage Vd. As a result, in Modification Example 3, it is possible to further improve the convenience.

3. OTHER MODIFICATION EXAMPLES

Hitherto, the present disclosure is described with the embodiments and the modification examples, but the present disclosure is not limited to the above embodiments, and various modifications may be made.

For example, in the embodiments and the like, the configuration example (shape, arrangement, the number of pieces, and the like) of the members in the printer and the ink jet head is specifically described using the example. However, the present disclosure is not limited to the above-described embodiments and the like, and members having another shape, arrangement, the number of pieces, and the like may be provided. Specifically, for example, in the ink jet head, a plurality of driving sections (driving circuits) may be cascade-connected (multistage-connected) or may be multi-drop connected to each other. A specific block configuration in the printer or the ink jet head is not limited to the above-described embodiments and the like, and other block configuration may be provided. Further, in the embodiments and the like, a case were the transmission data transmitted from the outside of the ink jet head to the inside thereof is data transmitted through the high-speed differential transmission path is described as an example. However, the present disclosure is not limited to this example. For example, the transmission data may not be data transmitted through the high-speed differential transmission path. In addition, in the embodiments and the like, a case where the transmission data is transmitted in a manner of LVDS is described as an example. However, the present disclosure is not limited to this example. For example, the transmission data may be transmitted using a physical layer in, for example, an emitter coupled logic (ECL) or a current mode logic (CML). In data transmission, for example, an embedded clock method in which the clock signal may not be transmitted, and data transmission is performed by incorporating a clock signal into a data line may be used.

Various types may be applied as the structure of the ink jet head. That is, for example, a so-called side shoot type of ink jet head that discharges the ink 9 from the central portion of the actuator plate in an extending direction of each discharge channel may be provided. Alternatively, for example, a so-called edge shoot type of ink jet head that discharges the ink 9 in the extending direction of each discharge channel may be provided. Further, the printer method is not limited to the method described in the above embodiments and the like, and various methods such as a thermal method (thermal method on demand type) and a micro electro mechanical systems (MEMS) can be applied, for example.

Further, in the embodiments and the like, a non-circulation type of ink jet head that uses the ink 9 without being circulated between the ink tank and the ink jet head is described as an example. However, the present disclosure is not limited to this example. That is, for example, the present disclosure can also be applied to a circulation type of ink jet head that circulates and uses the ink 9 between the ink tank and the ink jet head.

In addition, in the embodiments and the like, the method of various kinds of arithmetic operation processing (various types of processing such as the inspection of the state of the ejecting section or acquisition of the parameter relating to ejection of the liquid) in the arithmetic operation section is specifically described. However, the method is not limited to the example described in the embodiment, and other methods may be provided. The parameter relating to ejection of the liquid is also not limited to the example (natural vibration period (2×AP value) in the ejecting section, the drive voltage in the printing driving signal, or the like) described by the embodiments and the like, and other parameters may be used. Specifically, examples of such other parameters include a period (tick ring period) of a tickling operation (operation of periodically applying a minute waveform that does not affect the discharge of liquid to the ejecting section) during discharge standby.

The series of processes described in the embodiments and the like may be performed by hardware (circuit) or may be performed by software (program) When the processes are performed by software, the software is configured by a group of programs for causing a computer to perform functions. Each program may be used by being incorporated in the computer in advance, or may be used by being installed on the computer from a network or a recording medium.

Furthermore, in the embodiments and the like, the printer (ink jet printer) 1 is described as a specific example of the "liquid-ejecting recording apparatus" in the present disclosure. However, the present disclosure is not limited to this example, and the present disclosure can be applied to devices other than the ink jet printer. In other words, the "liquid ejecting head" (ink jet head) in the present disclosure may be applied to devices other than the ink jet printer. Specifically, for example, the "liquid ejecting head" in the present disclosure may be applied to a device such as a facsimile or an on-demand printing machine.

In addition, the various examples described here may be applied in any combination.

In addition, the effect described in this specification is just an example and is not limited. Other effects may be obtained.

The present disclosure may have configurations as follows.

<1> A liquid ejecting head comprising: an ejecting section including a plurality of nozzles for ejecting liquid; a driving circuit that drives the ejecting section based on a printing driving signal to eject the liquid from the nozzles; a power supply path connected to the driving circuit; a detection section that acquires measurement data based on a detection result of a current flowing on the power supply path; and an arithmetic operation section that performs both an inspection of a state of the ejecting section and acquisition of a parameter for ejection of the liquid based on the measurement data obtained by the detection section.

<2> The liquid ejecting head according to <1>, wherein the arithmetic operation section performs both an inspection of a filling state of the ejecting section with the liquid, as the state of the ejecting unit, and the acquisition of the parameter relating to ejection of the liquid, based on a plurality of pieces of the measurement data obtained using a plurality of inspection driving signals having different periods each other.

<3> The liquid ejecting head according to <2>, wherein the arithmetic operation section inspects the filling state with the liquid by determining whether or not each of the plurality of pieces of measurement data has a local maximum value which is equal to or more than a threshold value.

<4> The liquid ejecting head according to <2> or <3>, wherein the arithmetic operation section inspects the filling state with the liquid based on a difference value between the plurality of pieces of measurement data.

<5> The liquid ejecting head according to any one of <1> to <4>, wherein the parameter is a natural vibration period (2×AP value) in the ejecting section.

<6> The liquid ejecting head according to any one of <1> to <4>, wherein the parameter is a drive voltage in the printing driving signal.

<7> The liquid ejecting head according to any one of <1> to <6>, wherein the arithmetic operation section further determines whether or not a setting parameter relating to ejection of the liquid is valid, based on a comparison result between an acquisition parameter and the setting parameter, the acquisition parameter being the parameter obtained based on the measurement data, and the setting parameter being set in the liquid ejecting head.

<8> The liquid ejecting head according to any one of <1> to <7>, wherein the arithmetic operation section transmits a notification of a result obtained by inspecting the state of the ejecting section and a result obtained by performing a predetermined determination based on the parameter, to an outside.

<9> A liquid-ejecting recording apparatus comprising the liquid ejecting head according to any one of <1> to <8>.

What is claimed is:

1. A liquid ejecting head comprising:

an ejecting section including a plurality of nozzles for ejecting liquid;

a driving circuit that drives the ejecting section based on a printing driving signal to eject the liquid from the nozzles;

a power supply path connected to the driving circuit;

a detection section that acquires measurement data based on a detection result of a current flowing on the power supply path; and an arithmetic operation section that performs both an inspection of a state of the ejecting section and acquisition of a parameter for ejection of the liquid based on the measurement data obtained by the detection section, wherein the arithmetic operation section performs both an inspection of a filling state of the ejecting section with the liquid, as the state of the ejecting unit, and the acquisition of the parameter relating to ejection of the liquid, based on a plurality of pieces of the measurement data obtained using a plurality of inspection driving signals having different periods each other.

2. The liquid ejecting head according to claim 1, wherein the arithmetic operation section inspects the filling state with the liquid by determining whether or not each of the plurality of pieces of measurement data has a local maximum value which is equal to or more than a threshold value.

3. The liquid ejecting head according to claim 1, wherein the arithmetic operation section inspects the filling state with the liquid based on a difference value between the plurality of pieces of measurement data.

4. The liquid ejecting head according to claim 1, wherein the parameter is a natural vibration period (2×AP value) in the ejecting section.

5. The liquid ejecting head according to claim 1, wherein the arithmetic operation section further determines whether or not a setting parameter relating to ejection of the liquid is valid, based on a comparison result between an acquisition parameter and the setting parameter, the acquisition parameter being the parameter obtained based on the measurement data, and the setting parameter being set in the liquid ejecting head.

6. The liquid ejecting head according to claim 1, wherein the arithmetic operation section transmits a notification of a result obtained by inspecting the state of the ejecting section and a result obtained by performing a predetermined determination based on the parameter, to an outside.

7. A liquid-ejecting recording apparatus comprising the liquid ejecting head according to claim 1.

* * * * *